United States Patent [19]

Anderson

[11] 4,166,554

[45] Sep. 4, 1979

[54] AEROSOL SAFETY CAP HAVING HINGED NOZZLE

[75] Inventor: Victor F. Anderson, Wenonah, N.J.

[73] Assignee: Shell Oil Company, Houston, Tex.

[21] Appl. No.: 508,374

[22] Filed: Sep. 23, 1974

[51] Int. Cl.[2] ..... B67D 5/06

[52] U.S. Cl. ..... 222/182; 222/402.1

[58] Field of Search ..... 222/153, 182, 402.1, 222/402.11, 402.12, 402.13; 239/588

[56] References Cited

U.S. PATENT DOCUMENTS

| | | | |
|---|---|---|---|
| 2,968,441 | 1/1961 | Holcomb | 239/588 |
| 3,143,254 | 8/1964 | Vanderhyde | 222/402.11 |
| 3,178,070 | 4/1965 | Leland | 222/402.1 |
| 3,211,384 | 10/1965 | Seaquist | 222/402.13 |
| 3,216,628 | 11/1965 | Fergusson | 222/402.1 |
| 3,305,179 | 2/1967 | Lehmann | 222/182 |
| 3,698,604 | 10/1972 | Nigro | 222/402.13 |

*Primary Examiner*—Joseph J. Rolla
*Assistant Examiner*—H. Grant Skaggs

[57] ABSTRACT

An aerosol dispenser having an overcap containing a valve actuator and dispensing nozzle, the outer end of the nozzle projecting through a window formed in the overcap so that the aerosol spray action takes place beyond the facade of the overcap. The nozzle structure includes a resilient hinged portion, so that depressing the projecting outer end of the nozzle from outside the overcap causes the nozzle to bend without applying an actuating motion to the valve actuator.

2 Claims, 7 Drawing Figures

AEROSOL SAFETY CAP HAVING HINGED NOZZLE

BACKGROUND OF THE INVENTION

Overcaps or covers for aerosol dispensers first came into common usage in order to provide an improved ornamental appearance for the product, but in recent years have been extensively modified and improved for safety reasons. More specifically, because of the poisonous or harmful nature of many chemical products being dispensed from commercial aerosol dispensers, legal requirements have been imposed with the objective of making these products safe for small children. Specifically, many aerosol dispensers now incorporate the single-finger entry principle such as that shown in the Corll U.S. Pat. No. 3,712,515 in order to make it possible for the dispensing valve mechanism to be actuated by the finger of an adult user but not to be actuated by the finger of a very small child.

In such child-safe aerosol dispensers the usual approach is for the dispensing nozzle to be wholly contained within the safety cap of the container.

When using a safety cap, permitting the nozzle to project beyond the confines of the safety cap would inherently create a risk that pressure could be applied to the nozzle as a means of actuating the dispensing valve. Such a result would entirely defeat the purposes of the safety cap.

The object and purpose of the present invention, therefore, is to provide a safety cap for an aerosol dispenser which is equipped with a nozzle that projects beyond the confines of the safety cap, but without endangering the child-safe nature of the device.

SUMMARY OF THE PRESENT INVENTION

According to the present invention the aerosol safety cap is provided with a valve actuator and dispensing nozzle and which are secured together so that they move as a unit. The outer end of the dispensing nozzle projects through a window formed in the safety cap, so that the aerosol spray action takes place beyond the facade of the cap or shroud. The mechanical construction of the actuator and nozzle assembly is so arranged, however, that while movement of the actuator will produce an equivalent movement of the nozzle the reverse of that relationship does not apply.

More specifically, the inner end of the dispensing nozzle, which is directly attached to the valve actuator, is provided with a resilient hinge portion. A downward force applied outside the safety cap on the projecting end of the nozzle simply causes the nozzle to bend in its resilient hinge portion, without producing a corresponding downward movement of the valve actuator. The reason for this result is that a rather heavy downward force is required in order to depress the valve actuator to its dispensing position, because of opposing spring pressure as well as the pressurized product inside the container.

The design of the dispensing nozzle and particularly the resilient portion thereof, is such that the bending of the nozzle will take place without imparting sufficient downward force to the valve actuator to result in a dispensing action.

DRAWING SUMMARY

PREFERRED EMBODIMENT

Figure 1:
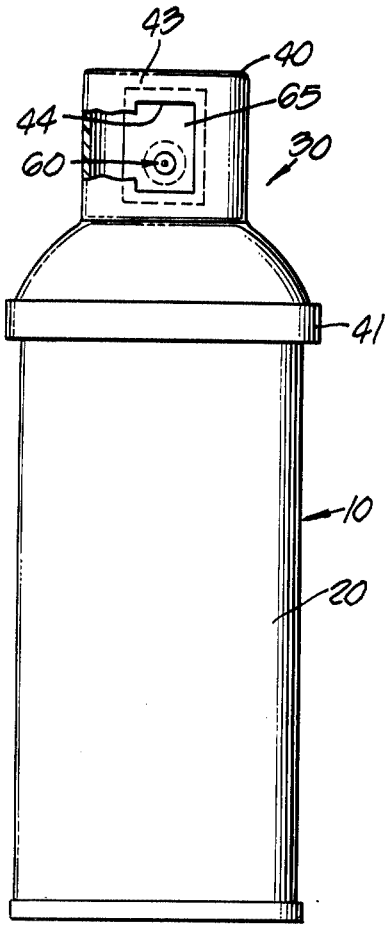
FIG. 1 is a front elevation view of the presently preferred form of the invention.
Figure 2:
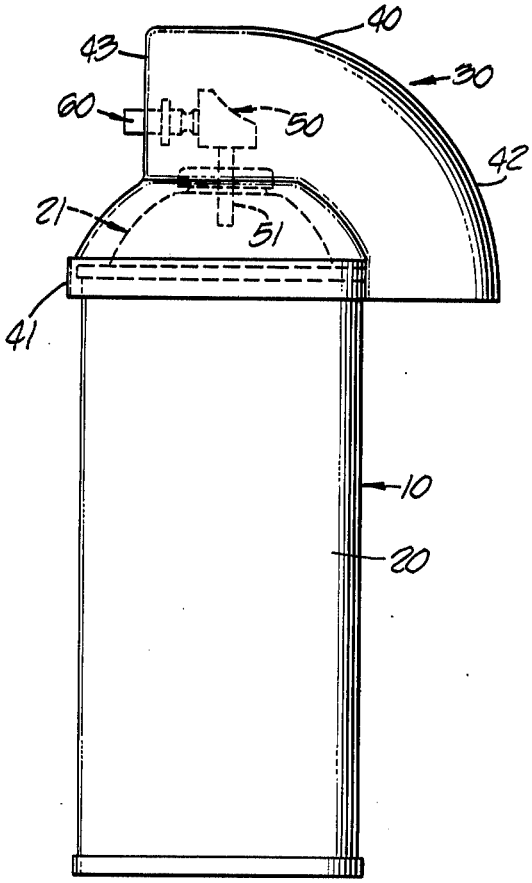
FIG. 2 is a side elevation view.

Reference is now made to the drawings, FIGS. 1 through 7, inclusive, illustrating the presently preferred form of the invention.

An aerosol dispenser 10 includes a cylindrical container 20 having a dome-shaped pressure head 21. The pressure dome 21 contains a conventional stem valve mechanism, not specifically shown.

Figure 6:
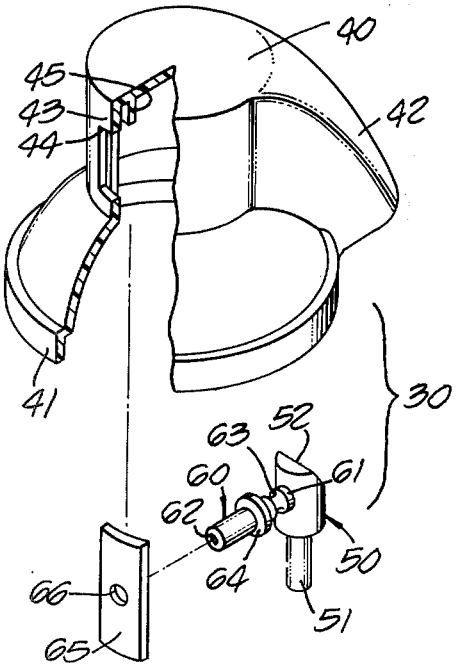
FIG. 6 is an exploded perspective view, partially in cross-section, of the component parts of the safety cap.

The safety cap assembly 30, shown in an exploded perspective view in FIG. 6 includes a number of separate parts. The cover or shroud is designated by numeral 40 and includes a lower circumferential flange 41 which is adapted to be secured to the circumferential crimped edge or bead on the upper end of container 20. A separate portion 42 of the shroud or cover 40 provides the single-finger entry passageway of the type that is illustrated and described in detail in the Corll U.S. Pat. No. 3,712,515. Cover 40 also has a generally vertical sidewall 43, disposed on the opposite side of the cover 40 from the finger passageway 42, and this sidewall 43 has a window opening 44 formed therein.

Also included in the safety cap assembly 30 is a valve actuator 50. Valve actuator 50 has a downwardly depending stem 51, as is conventional, which stem engages the conventional stem valve mechanism, not shown. Actuator 50 on its upper rearward corner has a concave surface 52 which is adapted to be engaged by the finger of a user of the aerosol dispenser, as is specifically shown in FIG. 4. A vertical passageway is provided through the stem 51 as shown by dotted lines in FIG. 7, and application of sufficient finger pressure on the surface 52 will cause the actuator 50 to move in a downward movement path by a sufficient distance towards the container 20 so as to open the internal valve mechanism and selectively dispense the contents from the container 20 in an upward direction to the stem 51 and hence through the actuator 50. Also included in safety cap assembly 30 is the dispensing nozzle 60, which has a generally tubular configuration and extends in a horizontal direction, perpendicular to the stem 51. The inner end 61 of dispensing nozzle 60 is permanently attached to the forward wall of the valve actuator 50, and as a matter of fact the nozzle 60 and valve actuator 50 are preferably integrally formed as a single plastic part. As is conventional, the passageway formed in the stem 51 for the fluid product continues upward into the valve actuator body 50, turns at substantially a right angle to a horizontally path and extends hence through the interior of dispensing nozzle 60 and on to the outer end 62 of the dispensing nozzle.

Figure 7:
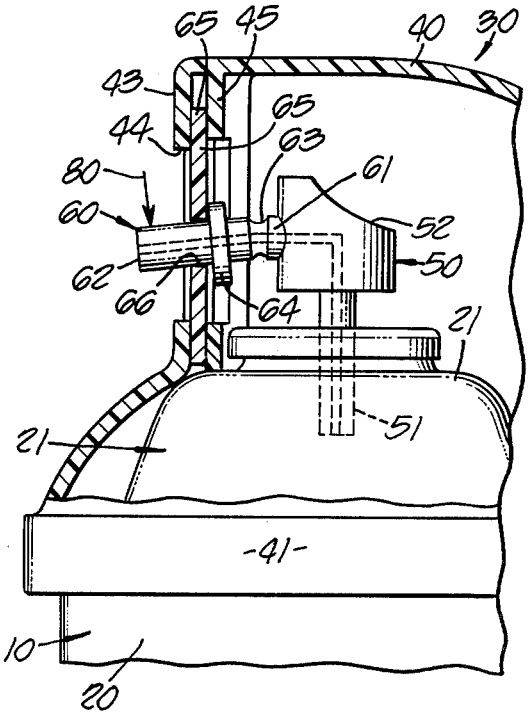
FIG. 7 is a view similar to FIG. 4, but showing the action when an attempt is made to dispense the contents of the container by depressing the projecting end of the nozzle.

Immediately adjacent the inner end 61 of nozzle 60 there is a reduced diameter portion 63, which acts as a resilient hinge portion of the nozzle. The operating principle here is well-known in that the resistance of a tubular member to bending movement applied along its length is a mathmetical function of the diameter of the tube. Where the external diameter of the tube is reduced, a more than proportionate share of the total bending action of the tube will be concentrated. This action is shown in FIG. 7 of the drawings, where arrow 80 indicates a downward force being applied either inadvertently or intentionally upon the projecting outer end 62 of the nozzle 60. As a result of this downward force the nozzle 60 bends significantly, and almost all of this bending action takes place at its reduced diameter portion 63.

In the illustration of FIG. 7, even though the nozzle 60 bends significantly at its resilient hinge portion 63, its inner end 61 attached to the valve actuator body 50 nevertheless applies a significant downward force to the actuator body 50. The actuator body 50 does not respond to this force, however, because its magnitude is insufficient. The reason is that this downward force is significantly less than the force level which is required to overcome the opposing force of the internal valve mechanism, not specifically shown.

GENERAL OPERATION

Figure 4:
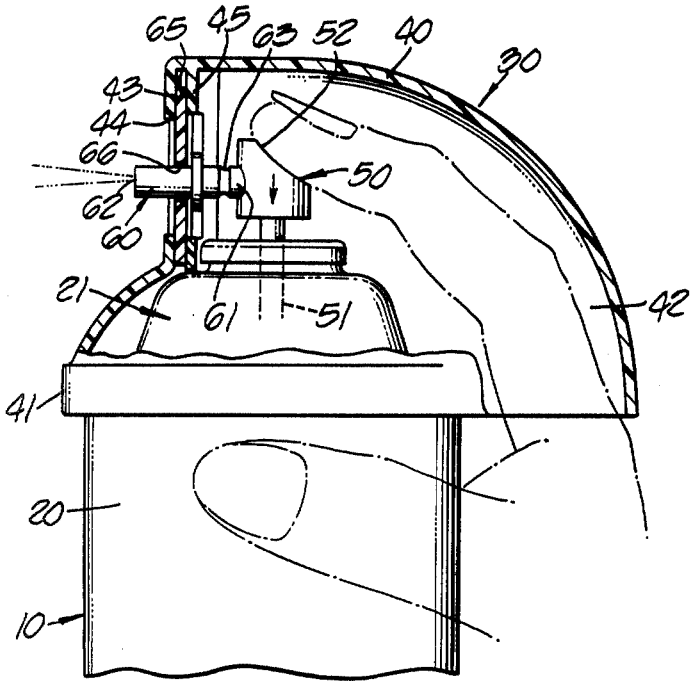
FIG. 4 is a cross-sectional view taken on the line 4—4 of FIG. 3, and illustrating the dispensing action of the device.
Figure 5:
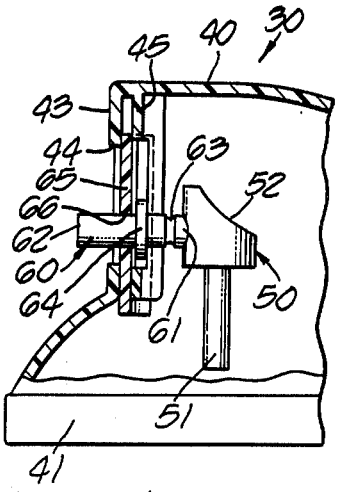
FIG. 5 is a fragmentary cross-sectional view showing the valve actuator in its fully depressed position.

In general, therefore, the operation of the invention is such that a finger actuation of the valve actuator 50 by insertion of a finger through the passageway 42 will be effective to actuate the internal valve mechanism of the aerosol dispenser, and hence selectively dispense contents from the container. Nozzle 60 moves downward in complete synchronism with the valve actuator 50, as illustrated in FIGS. 4 and 5. When the finger pressure on surface 52 is released, nozzle 60 will also move upward in synchronism with the valve actuator.

The reverse relationship, however, does not apply. Only the outer end 62 of nozzle 60 is directly accessible to the finger of the user, and by applying a downward force from outside the shroud 40, as illustrated in FIG. 7, a significant bending movement of the nozzle 60 will take place, but this is insufficient to result in a dispensing action, for the reasons previously described.

ADDITIONAL STRUCTURAL DETAILS

Figure 3:
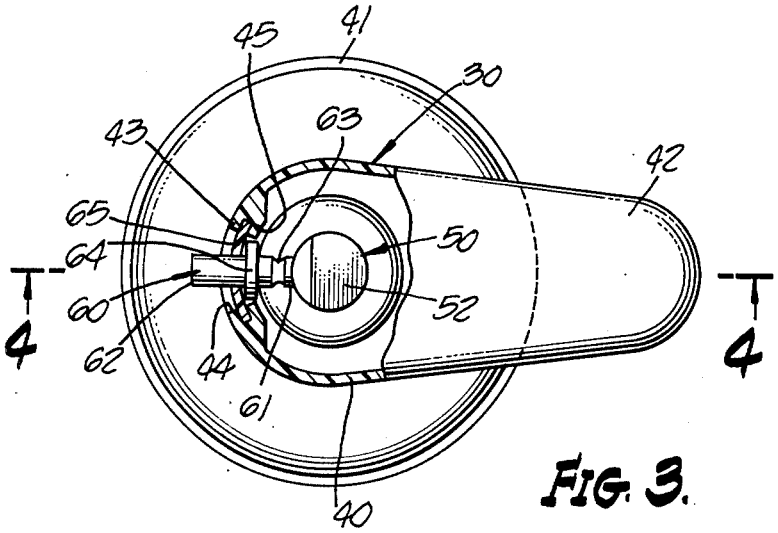
FIG. 3 is a top plan view, partially in cross-section.

It is preferred to form the shroud or cover 40 with an internal wall 45 which is parallel to the wall 43 and spaced a short distance from it, both of these wall sections being of an arcuate configuration as best seen in FIG. 3. It is also preferred not to leave the window 44 entirely open, but to utilize a slide 65 which is captured between the wall sections 43, 45. Slide 65 has a generally rectangular configuration but is somewhat arcuately curved along its shorter dimension, as best seen in FIG. 3. Slide 65 also has a central opening 66 formed therein, through which the projecting end portion of nozzle 60 is inserted. The space between wall sections 43, 45 provides a guideway for the slide 65, and the vertical dimension of this guideway is significantly greater than the vertical length of the slide 65. Therefore, in the extreme upper position of actuator 50 as shown in FIG. 4 the slide 65 is in a relatively raised position and the nozzle 60 is horizontal, while in the extreme lower position of the actuator 50 as shown in FIG. 5 the slide 65 is in a relatively lower position and the nozzle 60 is still horizontal.

A further structural detail of the preferred form of the invention is a ring 64 which is formed integral with the nozzle 60 and is located about midway of the length of the nozzle 60. In the assembled position of the apparatus the ring 64 engages the interior surface of slide 65, and therefore insures a relatively constant lateral position of the nozzle 60 relative to the valve actuator 50.

A safety cap assembly 30 may therefore be assembled from only three separate parts: The shroud or cover 40, including its finger passageway 42, forward wall 43 with window 44, inner wall 45, and mounting flange 41; the valve actuator 50 having parts 51, 52 with which the nozzle 60 having parts 61, 62, 63, 64 is integrally formed; and the slide 65. The projecting end of nozzle 60 is first inserted into the opening 66 of slide 65, and then the combined assembly of valve actuator 50, nozzle 60, and slide 65 are inserted vertically upward into their respective positions inside the shroud or cover 40.

Although not specifically shown in the present drawings, it is preferred either to provide means for permanently securing the attachment flange 41 to the upper end of container 20, or else capture the nozzle 60 within the shroud 40 in order that removal of the shroud would guarantee removal of the valve actuator 50, thereby maintaining the child-safe condition of the dispenser.

The invention has been described in considerable detail in order to comply with the patent laws by providing a full public disclosure of at least one of its forms. However, such detailed description is not intended in any way to limit the broad features or principles of the invention, or the scope of patent to be granted.

I claim:

1. An aerosol dispenser comprising:

an aerosol container;

a valve actuator disposed above said container and adapted to be depressed in a downward movement path towards said container for selectively dispensing contents therefrom;

a cover secured to the upper end of said aerosol container and extending about said valve actuator, said cover having a finger-entry passageway communicating with an aperture on one side of said cover, and a generally vertical side wall in which a window is formed, said window being disposed substantially parallel to said movement path of said actuator; and a dispensing nozzle attached to said actuator and extending in a generally horizontal direction therefrom towards said window with the outer end of said nozzle projecting through said window;

said nozzle having a resilient hinge portion of reduced external diameter on its inner end whereby depressing said actuator directly from inside the cover causes contents to be dispensed from said container, but depressing the outer end of said nozzle from outside the cover causes said resilient hinge portion of reduced external diameter to bend without producing sufficient downward force on said actuator to result in a dispensing action.

2. A safety cap assembly for an aerosol dispenser comprising:

a shroud having a circumferential flange adapted for attachment to the upper end of a cylindrical aerosol container, a finger-entry passageway communicating with an aperture on one side of said shroud, and a generally vertically sidewall opposite said finger entry passageway, said sidewall having a window formed therein;

slideway means associated with said window;

a slide vertically movable within said slideway means; and a valve actuator and a dispensing nozzle integrally formed as a single unit, said valve actuator having a downwardly depending stem with a fluid passageway formed therein, said dispensing nozzle extending perpendicular to said stem of said valve actuator and having a fluid passageway therein communicating with said passageway of said stem, said nozzle having a resilient hinge portion adjacent said actuator, and the outer end of said nozzle being inserted through the opening of said slide;

whereby when said flange is secured to the upper end of an aerosol container and said stem is inserted into the dispensing valve mechanism thereof, the container contents may be dispensed by finger actuation of said valve actuator but the application of force to the projecting end of said nozzle from outside the shroud will cause said nozzle to bend at said resilient hinge portion thereof without imparting sufficient downward force to said actuator to result in a dispensing action.

* * * * *